United States Patent [19]

Funke et al.

[11] Patent Number: 4,559,799

[45] Date of Patent: Dec. 24, 1985

[54] ROLLING MILLS

[75] Inventors: Günther Funke; Hans-Joachim Eick, both of Siegen, Fed. Rep. of Germany

[73] Assignee: Kocks Technuk GmbH & Co., Hilden, Fed. Rep. of Germany

[21] Appl. No.: 304,668

[22] Filed: Sep. 22, 1981

Related U.S. Application Data

[63] Continuation of Ser. No. 35,077, May 1, 1979, abandoned.

[30] Foreign Application Priority Data

May 5, 1978 [DE] Fed. Rep. of Germany ..... 2819567

[51] Int. Cl.[4] ..... B21B 13/08

[52] U.S. Cl. ..... 72/224; 72/229; 72/234

[58] Field of Search ..... 72/194, 224, 225, 229, 72/231, 234, 366

[56] References Cited

U.S. PATENT DOCUMENTS

| | | | |
|---|---|---|---|
| 2,290,176 | 7/1942 | Garand | 72/224 |
| 2,361,729 | 10/1944 | Nedden et al. | 72/225 |
| 4,044,586 | 8/1977 | Properzi | 72/224 |

FOREIGN PATENT DOCUMENTS

| | | | |
|---|---|---|---|
| 952524 | 11/1956 | Fed. Rep. of Germany | 72/224 |
| 47-785 | 12/1972 | Japan | 72/224 |

*Primary Examiner*—Lowell A. Larson
*Assistant Examiner*—Jorji M. Griffin
*Attorney, Agent, or Firm*—Buell, Ziesenheim, Beck & Alstadt

[57] ABSTRACT

A rolling mill is provided with at least one roll stand for rolling bar material having three adjustable driven roll disks arranged radially to the axis of the rolled material, the maximum working surface of at least one of said disks being at least 20% wider than the maximum working surface of the other two roll disks.

6 Claims, 9 Drawing Figures

ROLLING MILLS

This is a continuation of application Ser. No. 35,077, filed May 1, 1979, now abandoned.

This invention relates to rolling mills and particularly to a rolling mill arrangement with at least one roll stand for rolling bar goods, with three adjustable driven roll disks arranged radially to the longitudinal axis of the rolled materials.

A roll stand of the above type, in which the three roll disks are displaced by 120° to each other, constitutes a part of the known body of technical knowledge through German Pat. No. 2,259,143. The advantages of the three-disk roll pass reside primarily in the fact that a better stretching of the rolled goods is achieved in the pass with a smaller broadening. Thus, a stretching of λ(coefficient of elongation)=3.5 can be achieved in the previously known three-disk roll pass. In addition, a more uniform deformation and consequently a more favorable stress distribution in the rolled material are obtained with a three-disk roll pass. As a result, materials with poor deformation characteristics, such as sintered tungsten or molybdenum, can also be flawlessly rolled in the three-disk roll pass. Furthermore, due to better deformation, the increase in temperature of the rolled goods during the rolling process is less in three-disk roll passes than in two-high roll passes of the same diameter and the same cross-section reductions, by means of which higher rolling velocities and thus a greater output and a better economy can also be achieved even at high mean tensile strength of the rolled materials. Structurally, it is advantageous for the forces to be absorbed in a three-disk roll stand that the forces are distributed on at least six bearings, while in two-high roll stands there are only 4 bearings. Consequently, a three-disk roll stand can absorb or exert higher rolling pressures.

Three-disk rolls that have a profiled pass are proposed in German Pat. No. 2,537,825 for use in a three-roll rolling mill, especially for the first roll passages of a strand coming from a casting machine. Thus, the roll disk should have a circular convex profile in the case of an original triangular cross section of the rolled goods. The underlying concept of this proposal is that the profiled disks exert a force in the rolled material that has a result essentially oriented toward the rolled material center. The idea of this construction is to avoid cracking during deformation. It is particularly designed for rolling aluminum and aluminum-magnesium alloys.

Finally, an individual driving of the three roll disks in the case of a roll stand in the three-disk arrangement is known from the DE-Gm (German Utility model Pat. No.) 1,807,019.

The present invention is based on the consideration that in the case of the familiar three-disk roll stands with adjustable roll disks the latter are brought together to a minimum roll gap after a few passages, and that the total stretching is thus limited. Based on this consideration, the present invention proposes to develop a rolling arrangement with a roll stand in the three-disk arrangement, with which a substantially greater total stretching is possible.

This problem is solved in the generically similar rolling mill arrangement with at least one roll stand having three roll disks by the fact that the maximum working surface of one of the three roll disks is at least 20% wider than the maximum working surface of each of the other two roll disks. The working surface is preferably 30% wider than that of the other two roll disks. In the usual implementation the working surfaces of the other two roll disks have practically the same width, i.e., they have a maximum difference in width of only ±5%.

Expediently, the roll disk whose axis is horizontal has a wider working surface. In this case, this roll disk with the wider working surface can form the upper or lower limitation of the pass. According to a particularly preferred construction, two roll disks exhibit a maximum working surface of width b, while the third, wider roll disk has a maximum working surface of width 1.4 b–2.0 b.

In the case of the roll disk, it may be a solid disk or a facing fastened onto an inner-lying carrier body. This facing offers particular cost advantages because the expensive material has to be provided only in the form of the facing.

The width of the maximum working surface is determined by the width of the maximum contact cross section of the rolled material. In the case of a rolled material with a multiangular contact cross section, the maximum working surface of the wider roll disk should preferably be at least 10% wider than the longest lateral surface of the contact cross section.

According to another embodiment, at least the working surface of the wider roll disk is profiled. This profiling can be achieved by a convex curving of the working surfaces to the middle of the roll disk, in which case the curvature is expediently flattened in the center.

However, an embodiment in which the working surface of the wider roll disk has a concave profiling is preferred. The profile is conveniently selected so that a pressure directed inward from the edges of the rolled material arises, such that dangerous tensile stresses that could easily lead to cracks are avoided. Thus, it has proved expedient in the case of a square contact cross section of the rolled material to provide the working surface of the wide roll disk with raised outer edges. Thus, the outer edge can be raised at an angle of preferably 15°–45° with respect to the horizontal working surface. The raised outer edges are provided so that they lie against two corners of the square billet in the contact cross section, while one of the other two roll disks with its non-profiled, essentially rectilinear working surface lies against the other two corners of the square billet.

The roll disks are adjustable so that in reversing operation the pass opening can be brought together in accordance with the deformation. The adjustability is also advantageous in continuously operating rolling mill arrangements in facilitating a change in format or for compensating wear. It has proved advantageous if the three roll disks are jointly adjustable.

In a particularly preferred rolling mill arrangement the roll stands with the three roll disks are driven in a reversing manner. Then either only one roll stand or two roll stands, one behind the other, can be provided, as desired. If two or more roll stands, one behind the other, are provided for the reversing drive, it is expedient if the disk with the wider working surface is displaced in the successive stands by 180° with respect to the others. If only one roll stand is used, it is convenient to have a canting device in front of and beyond the stand so that the rolled material can be turned by the desired angle.

In a rolling mill arrangement with a continuous roll stand setup, with at least three roll stands, one behind the other, at least the first two roll stands have three roll disks, one of which has the wider working surface and where in the second roll stand the roll disk with the wider working surface is displaced by 180° with regard to the first stand.

Care should be taken in both the reversing and continuously operating rolls so that in the successive roll passages the working surfaces of the roll disks make contact with the surface of the rolled material that was free of pressure in the previous roll passage. The surface on which the broadening occurs is involved here. This deformation concept is known in principle in order to achieve a definite final cross section.

The rolling mill arrangement is suitable for various original cross sections, round or multiangular. However, particular advantages are evident in the rolling of rectangular and especially square rolled material. In the case of square rolled material original cross sections with a side length of 100–400 mm are preferred. The square original cross section permits utilizing practically the entire working surface of the wider roll disk with the one lateral length of the charge material, while the two other roll disks make contact at the edges of the square original cross section. The wide roll disk with the largest working surface determines the maximum original cross section, while the two narrow roll disks can exert the full rolling function. This results in a saving of material for the narrow roll disks. An even greater advantage resides in the fact that the pass opening can be brought together much more than with the roll disks of the previously known arrangement. This advantage is illustrated in the drawing by means of a square billet; it is particularly evident in the case of square original cross sections. The same is true to a somewhat lesser degree for the other original cross sections also.

The rolling mill arrangement with the described roll stand is suitable for the hot or cold rolling of metals. The particular advantages are evident in the case of metals that are difficult to shape, especially in high-alloy steels. The particular advantages are thus evident in austenitic and ledeburitic steels, high-temperature steels, and tool steels.

The three-disk arrangement offers the advantage that the final cross sections produced have a very good surface because each of the three roll disks acts uniformly on the rolled material without any relative movements between roll and rolled material, which are unavoidable in the case of the serrated pass openings. This also has an advantageous effect on the service life of the roll disks because the wear on the working surfaces is substantially reduced.

The substantial stretching of $\lambda > 5$, in particular $\lambda > 7$, is advantageous in the described roll stand. A total stretching of $\lambda =$ about 9.0 can be achieved. It is thus possible to pass from a large original cross section to a very small final cross section with few or even only one reversing driven stand. This is a substantial advantage, especially with regard to extruded steel billets. It is advantageous here that a multiplicity of final cross sections of varying size can be produced from one original cross section (cross section predetermined by the extrusion mold).

In the foregoing general description of this invention and its background we have pointed out certain objects, purposes and advantages of the invention. Other objects, purposes and advantages of this invention will be apparent from a consideration of the following description and the accompanying drawings in which.

Figure 1:
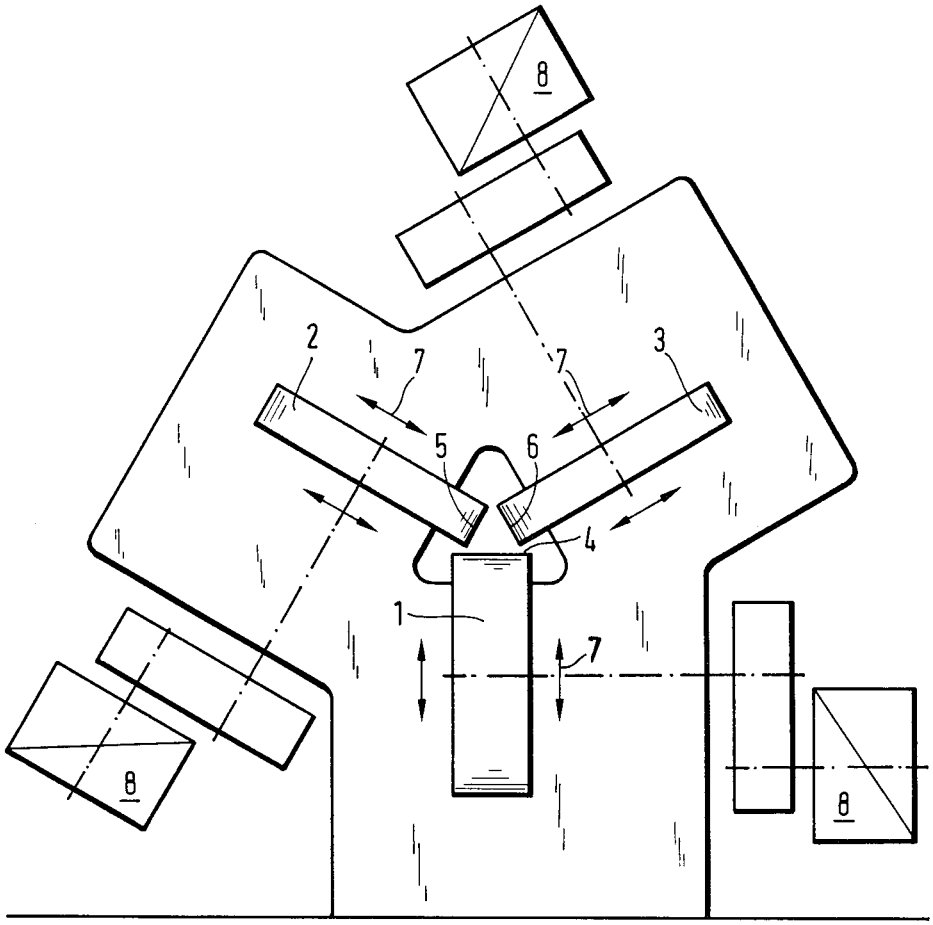
FIG. 1 shows a front elevation of a roll stand of the rolling arrangement of this invention.

Referring to the drawings and viewed in the direction of the rolled material, FIG. 1 shows a roll stand with three adjustable driven roll disks 1, 2, and 3 facing the longitudinal axis of the rolled material (three-disk arrangement). The roll disks 1, 2, and 3 respectively have a working surface 4, 5, and 6. The common adjusting arrangement 7, symbolically represented by arrows, is provided for all three roll disks 1, 2, and 3 for adjusting the pass opening. Each of the three roll disks 1, 2, and 3 has an independent drive 8. The axis of rotation of the lower roll disk 1 is horizontal, while those of the other two roll disks 2 and 3 are at an angle of 45° to the horizontal. The roll disks 2 and 3 have working surfaces 5 and 6 of equal width. On the other hand, the working surface 4 of the lower roll disk 1 is considerably wider. The working surface 4 of the roll disk 1 is approximately 1.7 times wider than each of the working surfaces 5 and 6 of the roll disks 2 or 3.

The enlarged segment (FIGS. 2 and 3) clearly shows the different widths of the working surfaces 4, 5, and 6. The enlarged segments (FIGS. 2 and 3) show with solid lines the position of the roll disks 1, 2, and 3 at the beginning of rolling and with dashed lines the position of the roll disks 1, 2, and 3 after rolling is completed. The square original cross section 20 at the beginning of rolling, e.g., of an extrusion billet, is reduced to a hexagonal cross section 24 after completion of rolling. In the alternative design according to FIG. 3 the wide working surface 4 of the roll disk 1 has outer edges 9 that are raised at an angle of about 20°. The raised outer edges 9 are located in the outer one-sixth of the working surface 4. The raised outer edge 9 passes to the edge into a shoulder-like horizontal flattening 10.

Figure 4:
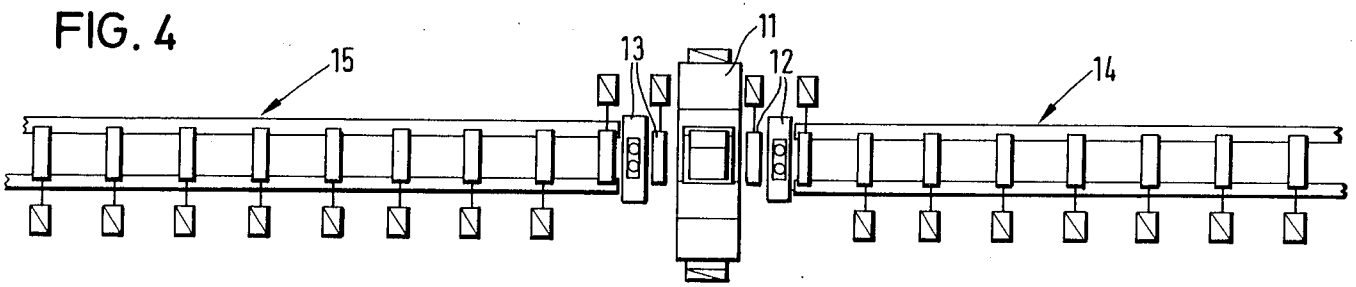
FIG. 4 shows a plan view of a first design of an overall rolling mill arrangement according to this invention.

FIG. 4 shows in plan view a first alternative of the overall rolling mill arrangement. In this alternative the three roll disks 1, 2, and 3 are arranged in a reversing stand 11. An edge and guide arrangement 12, 13 is provided in front of and behind the reversing stand 11. The roll tables 14 and 15 are connected to these. The reversal of the direction of movement of the rolled material during passage through the reversing stand 11 is indicated by arrows.

Figure 5:
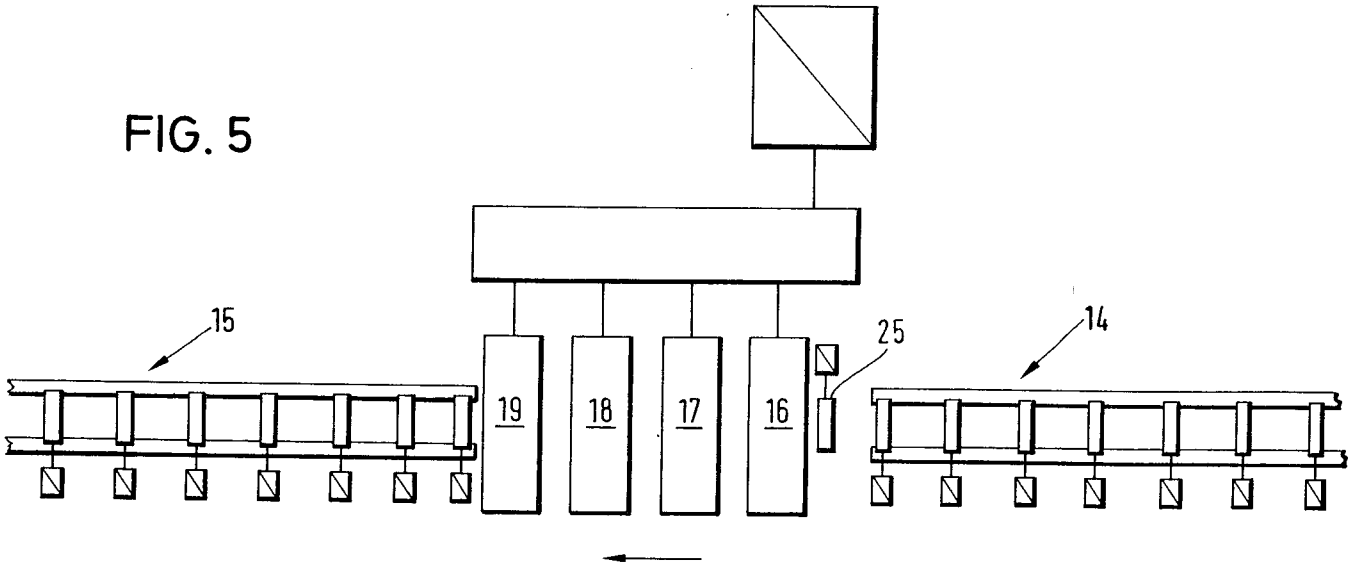
FIG. 5 shows a plan view of a second design of an overall rolling mill arrangement.
Figure 6:
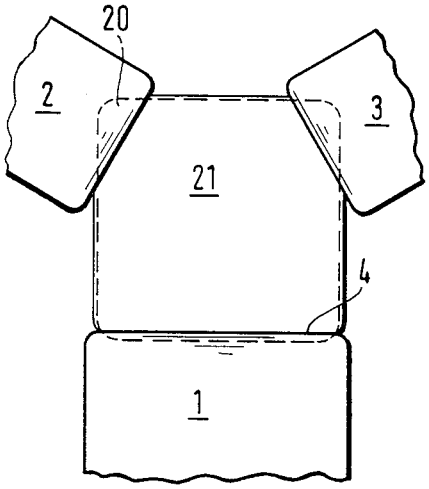
FIGS. 6–9 show a pass sequence for the rolling mill nip of FIG. 2.

The rolling mill arrangement shown in FIG. 5 operates continuously with four roll stands 16, 17, 18, 19 arranged one behind the other. The direction of movement of the rolled material is indicated by an arrow. The rolled material comes from the roll table 14 through the guide arrangement 25 to the first roll stand 16. The first roll stand 16 and the second roll stand 17 are designed as three-disk roll stands with the overwidth roll disk 1. The subsequent roll stands 18 and 19 are three-disk roll stands in a previously known construction, i.e., with three roll disks of equal width. In the first two roll stands 16 and 17 the axis of rotation of the over-width roll disk 1 is horizontal in both cases. However, the roll disks 1 located in roll stands 16 and 17 are displaced by 180° with regard to each other. In the first roll stand 16 the working surface 4 of the over-width roll disk 1 forms the lower limit of the pass opening and in the second roll stand 17 the working surface 4 of the over-width roll disk 1 forms, the upper limit of the pass opening.

Figure 2:
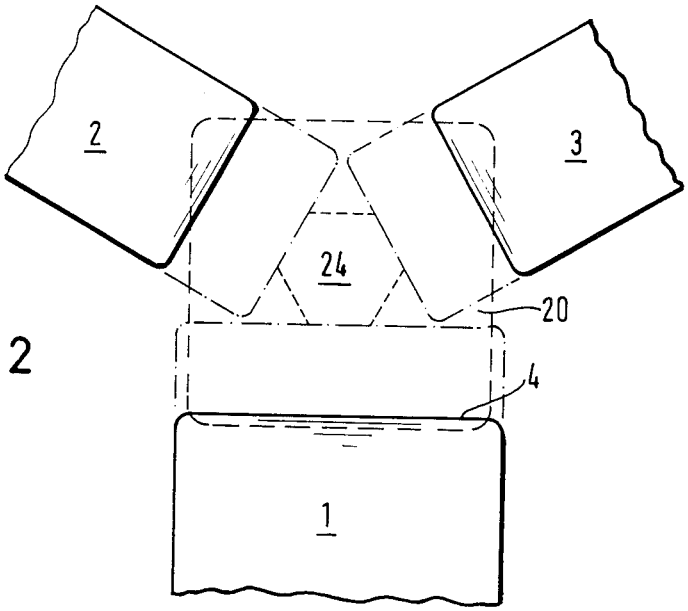
FIG. 2 shows an enlarged fragmentary elevation of the roll nip of FIG. 1 with indicated deformation course of the rolled material with various positions of the roll disks.
Figure 7:
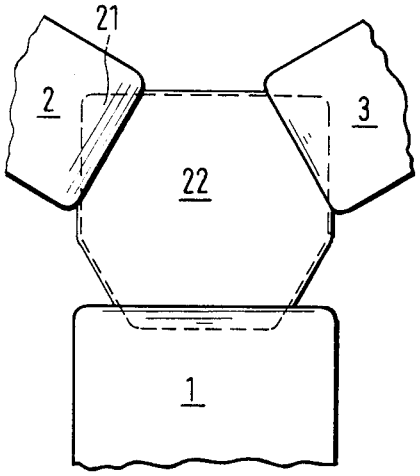

The first four passes, as they can be effected with a roll stand described in FIGS. 1 and 2, are shown in FIGS. 6–9. The original cross section is depicted by dashed lines and the final cross section by solid lines. The reference number of the original cross section is written outside of the cross section and the reference number of the final cross section was written on the cross section surface. During the first pass (FIG. 6) the original square cross section 20, e.g., an extrusion billet, is deformed with about 10% reduction to a final cross section 21. It should be noted that the rolled material coming from the roll table 14 lies with its full lateral length on the working surface 4 of the wide roll disk 1 and is deformed by the latter. The two upper-lying edges of the rolled material are deformed by the upper two roll disks 2 and 3. During the second pass (FIG. 7) the rolled material and the pass opening have an attitude displaced by 180° with regard to each other. As described in connection with FIG. 5, this displaced arrangement can be achieved in a continuously operating rolling mill arrangement by another arrangement of the roll disk 1 in the second stand 17. In the case of a rolling mill arrangement with reversing drive (FIG. 4) the rolled material is turned by 180° after the first pass by means of a canting arrangement and fed into the second pass as shown in FIG. 7 after reversing the direction of movement. The roll disks 1, 2, and 3, are newly adjusted during the turning of the rolled material. During the second pass the roll disks 2 and 3 then act on the edges of the rolled material, which were located in the region of the working surface 4 of the over-width roll disk 1 during the first pass. The rolled material leaves the second pass with the final cross section 22. The pass reduction is about 17% during the second pass.

Figure 8:
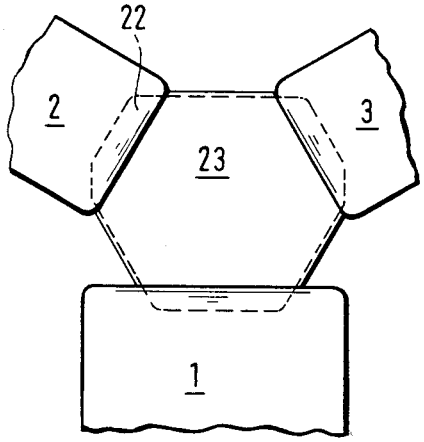
Figure 9:
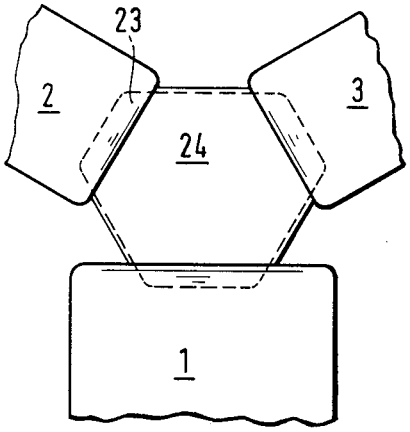

After the second passage the rolled material is again turned by 180° and after another adjustment of the three roll disks 1, 2, and 3 fed into the third pass shown in FIG. 8. The reduction in the third pass is ca. 18%. The rolled material leaves the third pass with the final cross section 23. This final cross section 23 already exhibits a somewhat hexagonal shape. A turning of the rolled material by 60° is thus sufficient for further rolling reduction. This is shown in the fourth pass (FIG. 9). The fourth pass is rolled with a cross section reduction of about 20% until the desired hexagonal final cross section 24 is reached. Of course, additional passes can follow the fourth pass until the desired final cross section is achieved, in which case the material is turned in the same manner by 60° and the roll disks are further moved together. The amount of adjustment and the degree of reduction are dependent on the quality of the material to be rolled. They can be selected according to need. The roll disks 1, 2, and 3 can be brought together to a minimum spacing that still avoids a mutual touching of the roll disks 1, 2, and 3. The minimal cross section to be achieved is thus determined. A numerical example for an alloy steel is given below. Alloy steel was rolled from an extrusion with a square cross section of 150 mm of lateral length and 10 mm edge radius to a 54 mm hexagon.

| Pass No. | Cross Section $mm^2$ | Stretching $\lambda$ | Turning after the pass by |
|---|---|---|---|
| STARTING MATERIAL CROSS SECTION 150 mm | 22414 | — | — |
| 1 | 20150 | 1.11 | 180° |
| 2 | 16800 | 1.20 | 180° |
| 3 | 13780 | 1.22 | 180° |
| 4 | 11020 | 1.25 | 60° |
| 5 | 8410 | 1.31 | 60° |
| 6 | 6420 | 1.31 | 60° |
| 7 | 4900 | 1.31 | 60° |
| 8 | 3740 | 1.31 | 60° |
| 9 | 2860 | 1.31 | 60° |
| 10 = 54 mm hexagon | 2525 | 1.13 | — |

With regard to the square cross section of the starting material of 150 mm of side length, a total stretching of $\lambda=8$ is calculated down to a final hexagonal cross section with a width over the flats of 54 mm.

If such a roll stand with an over-width roll disk is used for a lesser total stretching, e.g., as a roughing stand component in front of a subsequent fine train or wire train, the width difference between the roll disk 1 and the disks 2 and 3 can be maintained smaller than in the case of a high total stretching. In the case of a lower total stretching, a turning of the rolled material by only 60° can be begun earlier during the course of rolling.

Figure 3:
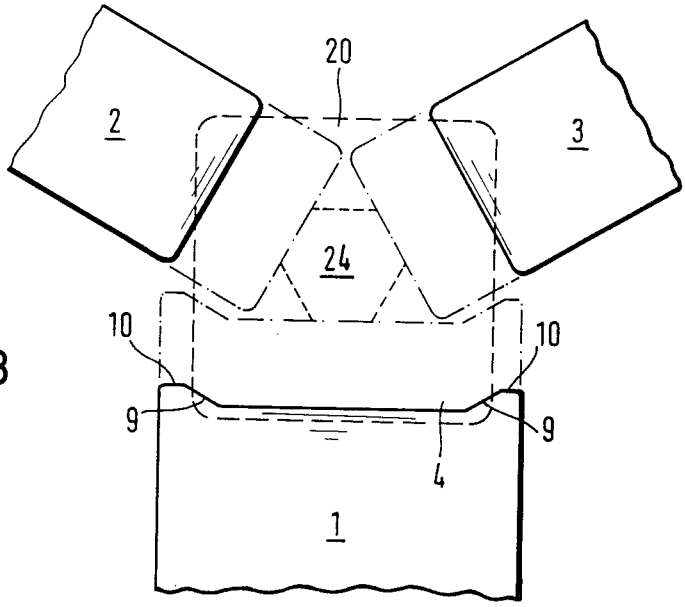
FIG. 3 shows an alternative design of to that of FIG. 2.

The alternative design of the over-width roll disk 1, shown in FIG. 3, offers the advantage that a pressure directed inward develops at all edges of the rolled material even during the first pass. This is particularly advantageous in the case of materials that are difficult to shape.

In the foregoing specification, we have set out certain preferred practices and embodiments of our invention, however, it will be understood that this invention may be otherwise embodied within the scope of the following claims.

We claim:

1. In a rolling mill arrangement with at least one roll stand for rolling billets into bar material of polygonal form having three adjustable drive roll disks arranged radially to the longitudinal axis of the rolled material so that their working surfaces lie on three intersecting lines defining a triangle, the improvement comprising a maximum working surface on one of the three disks which is at least 20% wider than the maximum working surface of each of the other two roll disks and characterized in that of the working surfaces of the rolls disks at least the working surface of the wider roll disk has a profile in which the major central portion is a straight line and the end portions are turned upwardly towards the other two rolls.

2. In a rolling mill arrangement according to claim 1 characterized in that the direction of rotation of the roll disks is reversible.

3. In a rolling mill arrangement with a roll stand according to claim 2, said other two roll disks have a maximum working surface of width b and the said one wider roll disk has a maximum working surface of width 1.4 b–2.0 b.

4. In a rolling mill stand as claimed in claim 3 having two roll stands, one behind the other, and means for operating said roll disks so that the direction of rotation is reversible.

5. In a rolling mill arrangement with a roll stand according to claim 4, said other two roll disks have a maximum working surface of width b and the said one wider roll disk has a maximum working surface of width 1.4 b–2.0 b.

6. In a rolling mill arrangement with a roll stand according to claim 1, said other two roll disks have a maximum working surface of width b and the said one wider roll disk has a maximum working surface of width 1.4 b–2.0b.

* * * * *

UNITED STATES PATENT AND TRADEMARK OFFICE

CERTIFICATE OF CORRECTION

PATENT NO. : 4,559,799

DATED : December 24, 1985

INVENTOR(S) : GUNTHER FUNKE, HANS-JOACHIM EICK

It is certified that error appears in the above-identified patent and that said Letters Patent is hereby corrected as shown below:

Column 1, line 47, change "result" to --resultant--.

Column 6, line 9, in the chart, after 150 mm insert -- ∅ --.

Column 6, line 47, change "drive" to --driven--.

Signed and Sealed this

*Twenty-seventh* Day of *May 1986*

[SEAL]

*Attest:*

DONALD J. QUIGG

*Attesting Officer*

*Commissioner of Patents and Trademarks*